United States Patent [19]

Griffin

[11] Patent Number: 4,716,919

[45] Date of Patent: Jan. 5, 1988

[54] PORTABLE BLIND WITH AUTOMATIC OPENING TOP

[76] Inventor: Dennis M. Griffin, 2310 SW. 304th St., Federal Way, Wash. 98023

[21] Appl. No.: 822,802

[22] Filed: Jan. 27, 1986

[51] Int. Cl.[4] ..... E04H 15/06; E04H 15/00; E04H 15/48

[52] U.S. Cl. ..... 135/106; 135/113; 135/901; 135/88

[58] Field of Search ..... 135/106, 101, 109, 111, 135/112, 102, 88, 900, 901

[56] References Cited

U.S. PATENT DOCUMENTS

| | | | |
|---|---|---|---|
| 124,239 | 3/1872 | Winslow | 135/102 |
| 1,125,484 | 1/1915 | Danyi | 135/102 X |
| 1,519,691 | 12/1924 | Mizrahi | 135/102 X |
| 2,142,851 | 1/1939 | Jolly | 135/102 |
| 2,488,809 | 11/1949 | Denn | 135/106 |
| 2,798,501 | 7/1957 | Oliver | 135/88 X |
| 2,877,722 | 3/1959 | Peat | 135/88 X |
| 3,424,178 | 1/1969 | Yazaki | 135/106 |
| 3,441,037 | 4/1969 | Transeau | 135/119 X |
| 4,558,713 | 12/1985 | Hagler et al. | 135/106 |

FOREIGN PATENT DOCUMENTS

| | | | |
|---|---|---|---|
| 5307 | of 1901 | United Kingdom | 135/102 |

*Primary Examiner*—Robert A. Hafer
*Assistant Examiner*—D. Neal Muir
*Attorney, Agent, or Firm*—Christensen, O'Connor, Johnson & Kindness

[57] ABSTRACT

Blind (8) is constructed with a tubular frame structure (10) and a tubular, automatic, bidirectionally opening top (12). The tubular elements of frame structure (10) are interconnected by upper and lower corner connectors (19) and (20). Top (12) is composed of a plurality of generally U-shaped rafter assemblies (40F, 40I and 40R) pivotally mounted on frame structure (10) to rotate about a common axis of rotation (48). A resilient cord (72) transversely spans the rafter assemblies and is connected to the forward rafter assembly (40F) and rearward rafter assembly (40R). Quick release latches interconnect the forward and rearward rafter assemblies to the upper portions of frame structure (10). When a particular latch assembly is released, the resilient cord (72), being in stretched condition, causes the rafter assemblies to automatically pivot in concert about common pivot axis (48) in the direction away from the released latch thereby to shift top (12) into open position.

21 Claims, 5 Drawing Figures

PORTABLE BLIND WITH AUTOMATIC OPENING TOP

TECHNICAL FIELD

The present invention relates to portable blinds and, more particularly, to portable blinds having an opening top for use in hunting, observation, or similar outdoor activities.

BACKGROUND OF THE INVENTION

Portable blinds are commonly used to provide concealment while hunting or observing wildlife. Typically, such structures are constructed of lightweight frame members capable of disassembly and compact storage to allow easy portability. When assembled, the frames are normally covered by camouflaging material to aid in concealing the structure and sheltering the occupants. To facilitate hunting or viewing at close range, it is desirable that the top or roof be easily and rapidly opened or removed. Ideally, with the top in open condition, the blind should allow unrestricted field of vision and freedom of movement by the occupants. Additionally, it is desirable that a blind be adaptable for use over a pit or hole in the ground.

Known inventions which attempt to achieve some of these desired results include U.S. Pat. Nos. 3,622,201, 2,811,977, and 3,323,530. One difficulty encountered with the known blinds is that the structural configurations interfere with vision and movement. In the '530 patent the single sloped roof in an open condition limits unrestricted viewing or movement by the occupant generally toward the direction of slope. In the '201 patent, one side of the structure is completely open, thus failing to provide total concealment. Also, the occupant must exit the structure through the opening in order to move about freely. The only alternative would be to entirely collapse the structure. This same difficulty is encountered in the '977 patent wherein the entire blind must be collapsed or folded to allow the occupant to exit the structure. Additionally, the blind in the '977 patent is attached to a seat which rotates as a unit with the blind about a vertical axis, thus attempting to give the occupant a 360° view. However, the movement of the blind could easily scare nearby wildlife.

When hunting certain types of game, a hole or pit in the ground is used to stand in for better camouflaging, with the opening being covered for shelter and concealment. None of the blinds of the above-mentioned patents is adapted for use over such pits. Specifically, neither of the shelters in the '530 and '977 patents can be reduced in height to provide a full range of vision and movement. Further, the configuration of the blinds disclosed in the '201 patent would require an unduly large hole or pit to accommodate the rotation of the blind.

SUMMARY OF THE INVENTION

To overcome the difficulties of known blinds, the present invention provides an automatic, bidirectionally opening top mounted on a supporting frame structure. The top is composed of several U-shaped rafter assemblies pivotally connected at each of their ends about a common pivot axis. Each rafter assembly is constructed with an elongate, intermediate section and arms disposed generally at right angles to the intermediate section. In a preferred form, the outward end of each arm is slidably engaged with elbows formed integrally with and disposed generally at right angles to the intermediate section. The opposite or free end of each arm is pivotally pinned to a U-bracket which is fixedly attached to the supporting frame structure. The free ends of the arms located at corresponding sides of the rafter assemblies preferably are pivotally connected to the U-bracket by a common pin thereby allowing the rafter assemblies to rotate in concert. Fabric camoflauge material is draped over the top to blend in with the surrounding environment.

When the top is in closed position, the rafter assemblies are spaced apart from each other across the opening being covered by the top. The rafter assemblies are held in such relative positions by elastic cords that extend transversely across and are connected to the rafter assemblies. The cords are in stretched condition when the top is in closed position. Quick release latches connect the rafter assemblies located closest along each side of the opening covered by the top to an adjacent portion of the frame. When one of the latches is released, the cord retracts causing the rafter assemblies to in concert pivot about their common pivot axis in the direction away from the released latch thereby to shift the top into open position. When the top is in open position the rafter assemblies are nested together along the side of the blind opposite the released latch so that substantially the entire blind is open, thereby giving the occupants maximum view of the wildlife being observed or hunted.

The supporting frame structure is constructed with elongated, tubular crossmembers detachably interconnected to corner posts by corner connectors. The corner connectors are formed of angularly-oriented sockets for receiving the ends of the crossmembers and posts. In the corner connectors used at the bottom of the frame structure, a web porton is formed integral with the socket to define a bearing surface for supporting the blind on the ground. A hole is formed in the web portion for use in anchoring the frame structure to the ground.

BRIEF DESCRIPTION OF THE DRAWINGS

Embodiments of the present invention are illustrated in the accompanying drawings, in which.

DETAILED DESCRIPTION

Figure 1:
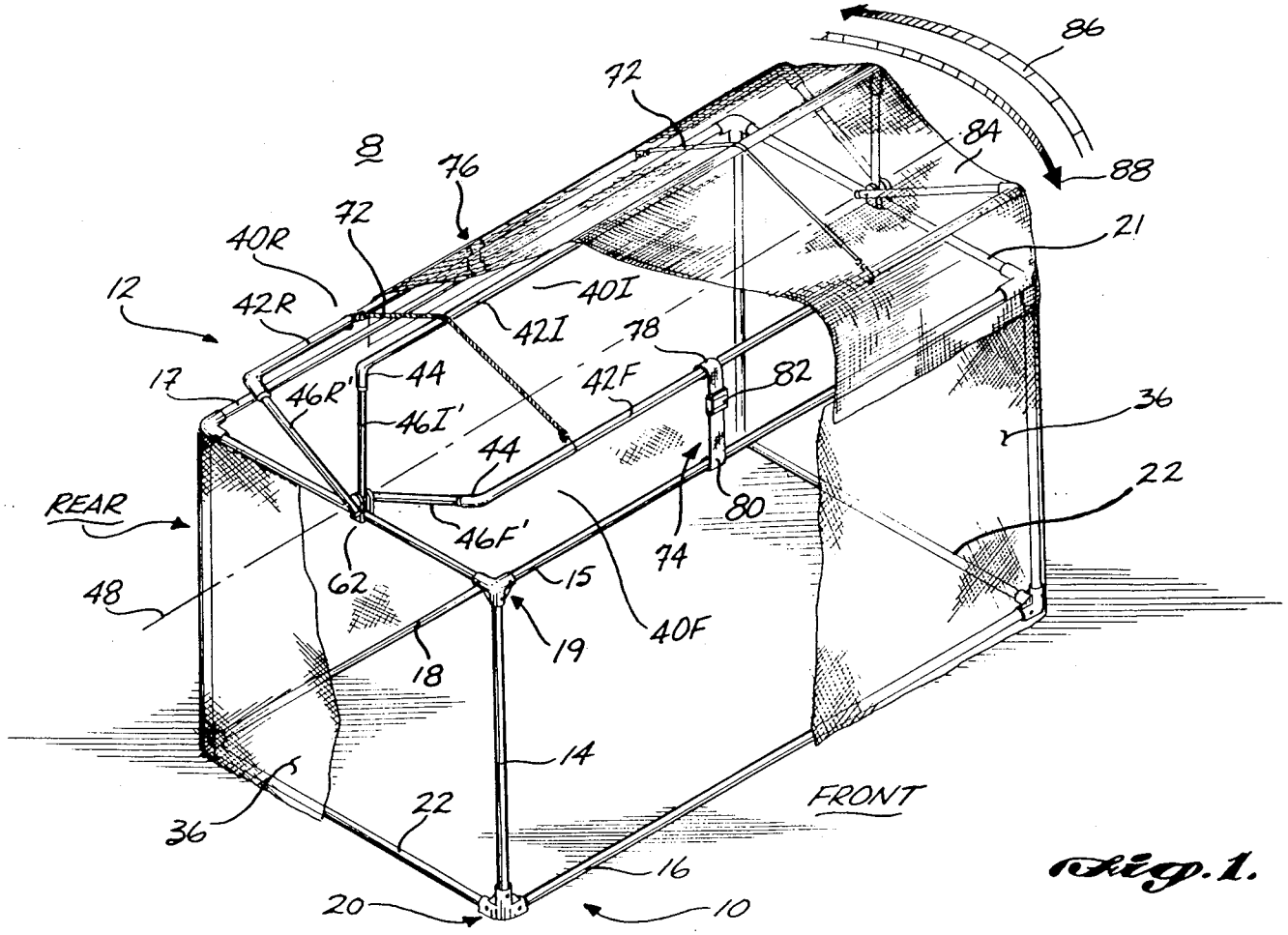
FIG. 1 is a perspective view of a portable blind constructed according to the present invention with the top disposed in closed position and with portions broken away for clarity.

FIG. 1 illustrates a portable blind 8 constructed according to the present invention and having a frame structure 10 that supports an automatic, bidirectionally opening top 12. Frame structure 10 is composed of elongated tubular members that are interconnected by corner connectors to form a generally rectangular shape. To facilitate the description of the present invention, the front and rear of blind 8 have been labeled; however, it is to be understood that these locations are arbitrary and could just as well be reversed without departing from the spirit and scope of the present invention. As shown in FIG. 1, frame structure 10 is composed of four upright, tubular corner posts 14 which are disengageably interconnected with the ends of upper and lower front tubular crossmembers 15 and 16 and the ends of upper and lower rear crossmembers 17 and 18 through the use of upper and lower corner connectors 19 and 20, respectively. The sides of frame structure 10 are composed of upper and lower elongate tubular members 21 and 22, the ends of which also disengageably engage within upper and lower corner connectors 19 and 20.

Preferably, members 14, 15, 16, 17, 18, 21 and 22 are constructed from lightweight, high-strength tubular material, such as aluminum, to facilitate the ease with which the blind, when disassembled, may be carried by the user while also being rugged enough to withstand inclement weather and rough usage. Although the tubular members are illustrated as being circular in cross section, other cross-sectional shapes, such as square or hexagonal, may be employed.

Figure 2:
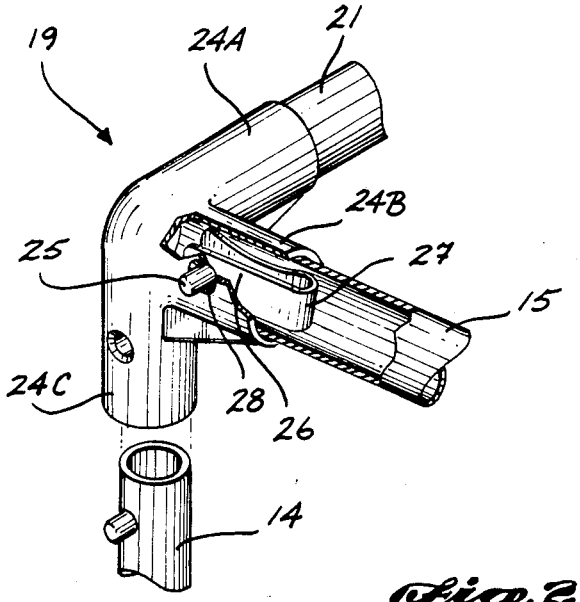
FIG. 2 is an enlarged, fragmentary, perspective view illustrating a top connector employed for interconnecting the tubular elements of the frame structure.

As depicted in FIGS. 1 and 2, upper corner connectors 19 are constructed with three integral socket portions 24A, 24B and 24C which are orthogonally disposed relative to each other, with the inside diameters of the socket portions being sized to snugly receive the corresponding end portions of tubular members 14, 15, 17 and 21. The manner in which such tubular members are detachably interconnected by upper corner connector 19 is detailed in FIG. 2. As illustrated in this Figure, a depressible or retractable elongated button 25 extends outward through a circular cross hole 26 extending through the wall at each end of the tubular members. Ideally, the two cross holes formed in the opposite ends of a particular tubular member are aligned with each other. The inner end of button 25 is mounted on one leaf of a resilient, generally U-shaped spring 27 disposed within the interior of the tubular members. Spring 27 serves to nominally urge button 25 outwardly through cross hole 26 so that the button extends radially outwardly from the outer surface of the tubular member. Preferably, U-shaped spring 27 is constructed from flat spring stock or similar material to provide the desired resilience to urge button 25 outwardly while permitting the button to be readily depressed inwardly into cross hole 26, as discussed more fully below. It is to be understood that U-shaped spring 27 may be replaced by springs or similar devices of other construction, such as a coil spring (not shown), without departing from the spirit or scope of the present invention.

As further illustrated in FIG. 2, cross holes 28 are formed in the socket portions 24A, 24B and 24C of upper corner connectors 19 for reception of buttons 25 during assembly of frame structure 10. To assemble a tubular member, such as member 15, with upper corner connector 19, member 15 is initially slidably inserted within a socket portion 24B of the corner connector until button 25 is approximately adjacent the outer end of the socket portion. Thereupon, button 25 is depressed to enable tubular member 15 to be further slidably engaged within socket portion 24B until button 25 is aligned with opening 28. Upon such alignment, spring 27 forces button 25 outwardly through opening 28 thereby locking tubular member 15 into engagement with corner connector 19 and preventing angular rotation of the tubular member 15 relative to the corner connector. To disassemble tubular member 15 from the corner connector 19, button 25 is simply depressed until button 25 is disengaged from opening 28 and then tubular member 25 is slidably disengaged from the corner connector. To facilitate full depression of button 25, opening 28 is beveled, as shown in FIG. 2. For proper angular alignment of buttons 25 with connector cross holes 28, ideally the cross holes 28 are located in the same relative positions in connector sockets 24A and 24B, for instance extending horizontally through the exterior sides of the sockets.

Figure 3:
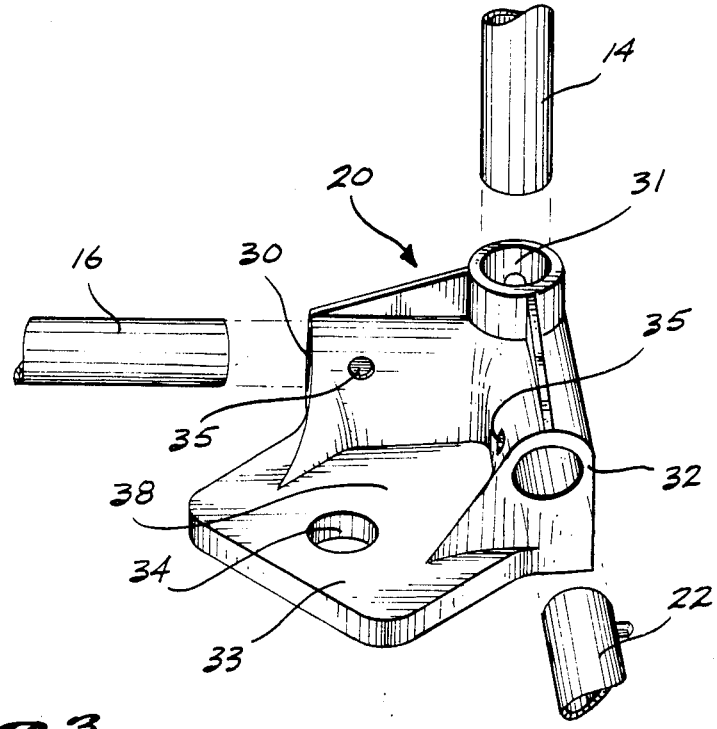
FIG. 3 is an enlarged, fragmentary, perspective view illustrating a bottom connector employed for interconnecting the tubular elements of the frame structure.

As illustrated in FIG. 3, lower corner connectors 20 are employed to interconnect the corresponding ends of tubular members 14, 16, 18 and 22. In a manner similar to upper corner connectors 19, lower corner connectors 20 are formed with three socket portions 30, 31 and 32 disposed generally orthogonally relative to each other. The inside diameters of the socket portions are sized to snugly receive the ends of the tubular members. Lower corner connector 20 also includes a flat web portion 33 which is integrally constructed with the socket portions 30, 31 and 32 to define a bearing surface to distribute the weight of blind 8 about the ground or other surface on which the blind has been assembled. In addition, web portion 33 adds significant structural integrity to the corner connector 20. An opening 34 is formed in web portion 33 to receive a stake, rope, or other means, not shown, employed to secure blind 8 to the ground or an immovable object, such as a rock.

In a manner similar to cross holes 28 formed in upper corner connector 19, lower corner connector 20 also is formed with cross holes 35 for reception of buttons 25 disposed in the end portions of tubular members 14, 16, 18 and 22, which members are engaged and disengaged from the lower corner connector 20 in the same manner as described above relative to upper corner connector 19.

Again referring to FIG. 1, a detachable outer cover 36, ideally composed of camouflaging fabric material, is detachably mounted on frame structure 10 by any well-known manner. For instance, ties or straps; not shown, can be fixedly sewn or otherwise attached to cover 36. The ties or straps can be engaged around the tubular members composing frame structure 10 thereby to secure the outer covering 36 to the frame structure.

As shown in FIG. 1, the automatic, bidirectionally-opening top 12 is composed of three generally U-shaped rafter assemblies 40F, 40I and 40R corresponding to the forward, intermediate and rear nominal positions of the rafter assemblies in FIG. 1. Each of the rafter assemblies is constructed with elongate, straight tubular intermediate portions 42F, 42I and 42R extending substantially along the entire length of frame structure 10 to terminate at relatively short elbow portions 44 disposed generally perpendicular to the intermediate portions. The elbow portions 44 of the rafter assemblies are detachably connectable with radial arms 46F, 46I and 46R, which arms are adapted to pivot about a common axis of rotation 48, as described more fully below. As most clearly illustrated in FIG. 4, elbow portions 44 are interconnected with the radially outward ends of arms 46F, 46I and 46R through the use of connector fittings 50 having plug portions 52 separated by a central shoulder portion 54. Plug portions 52 engage within the hollow outward ends of arms 46F, 46I and 46R and within the hollow ends of the elbow portions 44 of rafter assemblies 40F, 40I and 40R. Central shoulder portion 54 abuts against the ends of the arms. Although not essential, ideally the outer diameter of shoulder portion 54 corresponds to the outer diameter of rafter assemblies 40F, 40I and 40R and arms 46F, 46I and 46R. Also, preferably the outer end portions of arms 46F, 46I and 46R are crimped at 55 to fixedly retain fittings 50 thereby to prevent them from becoming lost or otherwise misplaced. It will be appreciated that by constructing rafter assemblies 40F, 40I and 40R with detachable arms 46F, 46I and 46R, upon disassembly of blind 8, the rafter asemblies advantageously occupy a small diameter envelope defined by the lengths of the elbow portions 44 of the rafter assemblies thereby minimizing the storage space required for the blind and also facilitating the ease with which the blind may be carried to a desired location by hunters and other users.

Figure 4:
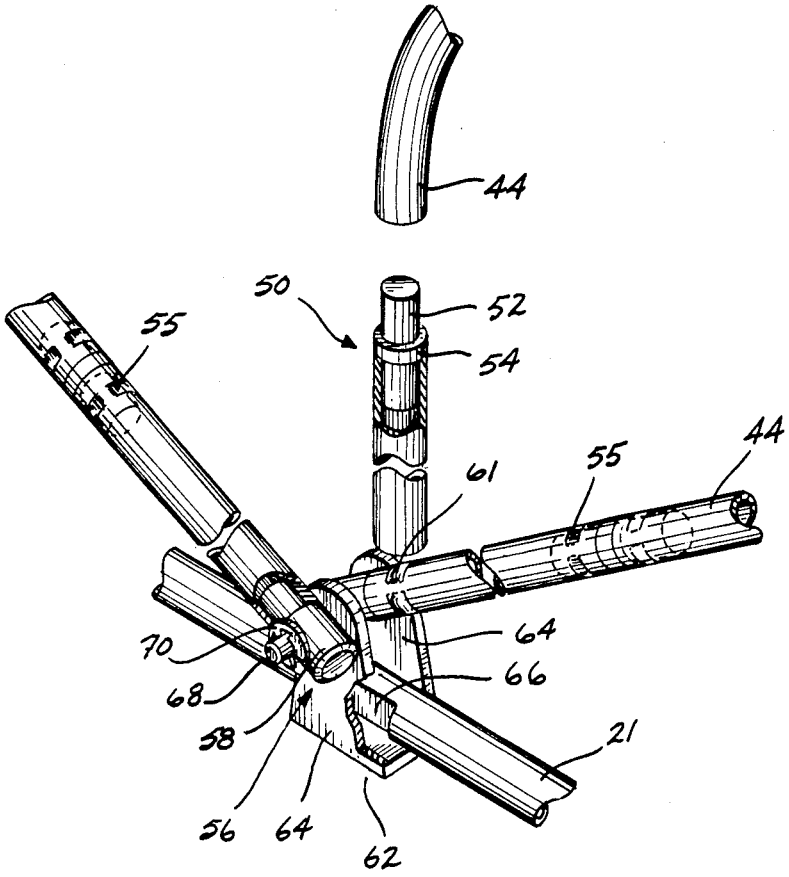
FIG. 4 is an enlarged, fragmentary, perspective view illustrating the manner in which the rafter assemblies are pivotally connected to the frame structure; and, FIG. 5 is a perspective view of another typical embodiment of the present invention wherein an automatic, bidirectionally opening top is employed for covering a hunting pit.

Referring specifically to FIG. 4, circular end plugs 56 are employed to close off the radially inward ends of arms 46F, 46I and 46R. Each end plug 56 is constructed with an enlarged head portion 58, ideally having a diameter corresponding to the outer diameter of the arms, and a smaller diameter neck portion 60 snugly engageable within the inside diameter of the arms. Preferably, end plugs 56 are fixedly secured to arms 46F, 46I and 46R by crimping of the arms at 61, use of adhesives, or by other well-known methods.

The radially inward ends of arms 46F, 46I and 46R are pivotally mounted on a generally U-shaped bracket 62 fixedly mounted on the central portions of the upper side members 21 of frame structure 10, FIGS. 1 and 4. The U-brackets 62 include spaced apart flange portions 64 that extend upwardly from opposite sides of upper side members 21. The U-brackets 62 are fixedly secured to upper side members 21 by use of weldments, adhesives or other well-known standard means. Ideally, if an adhesive is employed, the portions of upper side members 21 disposed between bracket flanges 64 are flattened to provide flat surfaces 66 to bear against the inside surfaces of flanges 64. A cross pin 68 extends along axis 48 through cross holes formed in end plugs 56 and aligned cross holes formed in flanges 64 of U-bracket 62. The cross pins 68 at each slide of the blind 8 are disposed in alignment with each other along rotational axis 48. Cross pins 68 are retained against disengagement from end plugs 56 and U-bracket 62 by E-rings 70 that engage within close-fitting grooves extending around the circumference of each end portion of the cross pins. It will be appreciated that rather than using E-rings 70, cross pins 68 may be retained by other well-known means, such as with cotter keys, not shown.

As illustrated in FIG. 1, resilient straps or cords 72 extend transversely across rafter assemblies 40F, 40I and 40R, with the ends of the cords anchored to forward rafter assembly 40F and rearward rafter assembly 40R. When top 12 is in the closed position shown in FIG. 1, cords 72 are in stretched condition tending to rotate the rafter assemblies toward each other; however, this is prevented by a latch assembly 74 extending between an intermediate location on forward rafter assembly 40F and the upper front member 15 of the frame structure, and a latch assembly 76 extending between an intermediate location on rearward rafter assembly 40R and the upper rear crossmember 17 of the frame structure. Latch assemblies 74 and 76 are composed of upper and lower strap portions 78 and 80 anchored to respective rafter assemblies 40F and 40R and to upper front and rear crossmembers 15 and 17, respectively. The free ends of the two strap portions are interconnected with a quick-release latch 82, similar to the type employed in seat belts, backpack waist belts and similar usages.

A fabric cover 84 overlies rafter assemblies 40F, 40I and 40R. Ideally, cover 84 is of a particular color and design to blend in with the surrounding environment, i.e., of camouflage design to match the surrounding vegetation or white when used in snow. Also, preferably, the portions of cover 84 that drape downwardly over front rafter assembly 40F and rear rafter assembly 40R are composed at least in part of mesh material to enable the occupants in the blind to clearly observe wildlife, game, etc.

It will be appreciated that by constructing blind 8 in the manner set forth above, top 12 may be conveniently opened in either the rearward or forward direction depending upon whether forward latch assembly 74 or rearward latch assembly 76, respectively, is released. For instance, if latch 82 of forward latch assembly 74 is released, the tension in cords 74 causes the forward and intermediate rafter assemblies 40F and 40R to rotate rapidly in the direction of arrow 86 in FIG. 1. The momentum of the rotating rafter members 40F and 40R causes rear rafter assembly 40R to also rotate in the direction of arrow 86 until the rafter assemblies nest together adjacent the upper rear crossmember 17 of frame structure 10 thereby leaving the top of the frame structure completely open. If rear latch assembly 76 is instead released, top 12 will automatically open in the same manner as discussed above; however, in the opposite direction, i.e., in the direction of arrow 88 shown in FIG. 1. It is to be understood that although the use of three rafter assemblies 40F, 40I and 40R is described above, fewer or more rafter assemblies may be employed without departing from the scope of the present invention.

Blind 8, when in unassemblied condition, occupies a compact package having a length generally corresponding to the lengths of frame structure crossmembers 15–8 and the lengths of rafter assembly intermediate portions 42F, 42I and 42R. Also, by constructing the rafter assemblies with disassemblable arms 46F, 46I and 46R, the rafter assemblies upon disassembly may be compactly stored alongside frame structure crossmembers 15–18 in, for instance, a small-diameter carrying bag, not shown.

The frame structure 10 is erected by assembling the elongate tubular members composing the frame structure with upper and lower corner connectors 19 and 20, as detailed above. The frame structure may be conveniently anchored, for instance, to the ground by driving an anchor pin, not shown, through openings 34 in lower corner connectors 20. Lastly, outer cover 36 is simply attached to the tubular members of the frame structure. Next, top 12 is conveniently assembled by engaging the open ends of elbow portions 44 with the plug portions 52 of fittings 50 extending outwardly from the radially outer end portions of arms 46F, 46I and 46R. Cover 84 is then draped over top 12 and secured to the rafter assemblies 40F, 40I and 40R of the top by the use of any convenient means, such as tie straps, not shown. Lastly, the latch assemblies 74 and 76 are interconnected, with the blind now ready for use. The blind is conveniently and quickly disassembled by reversal of the foregoing assembly procedure.

Figure 5:
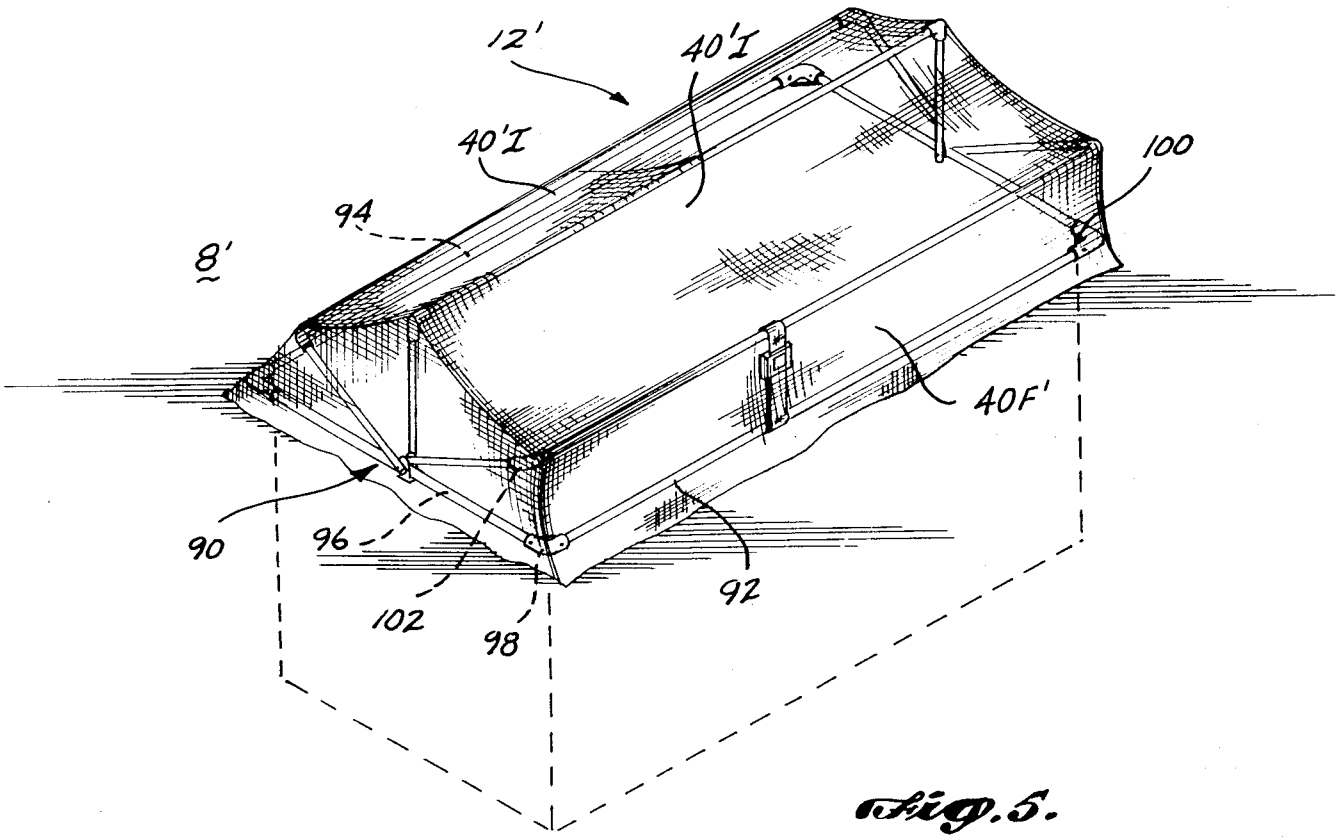

FIG. 5 illustrates another preferred embodiment of the present invention adapted to cover the top of a hole or pit formed in the ground. Blind 8' is composed of a top 12' mounted on a generally rectangularly-shaped perimeter frame 90 generally composed of the upper portion of frame structure 10 of blind 8 illustrated in FIG. 1. Perimeter frame 90 includes front and rear crossmembers 92 and 94 corresponding to upper front and upper rear crossmembers 15 and 17 of frame structure 10, and also includes side members 96 corresponding to upper side members 21 of frame structure 10. The ends of crossmembers 92 and 94 and side members 96 are interconnected with corner connectors 98 which are constructed similarly to lower corner connectors 20 of blind 8, but without a center socket 31. Ideally, corner connectors 98 are constructed with an opening, not shown, formed in web portion 100 for reception of a peg, stake, or similar member, not shown, for anchoring the corner connectors to the ground or other immovable object. It is to be understood that corner connector 20 may be used in place of corner connector 78.

With the foregoing exceptions and the additional exceptions noted below, top 12' preferably is constructed and operated in the same advantageous manner as top 12 described above. Top 12' is mounted on perimeter frame 90 in the same manner in which top 12 is mounted on frame structure 10, described above. As such, top 12' is adapted to open in the same convenient, automatic, bidirectional manner as in top 12, described above. However, one difference between tops 12 and 12' is that in top 12' the rafter assemblies 40F', 40I' and 40R' are constructed with elbow portions 102 having an inside diameter sized to snugly receive the outer end portions of arms 46F', 46I' and 46R' rather than utilizing the connector 50, illustrated in FIGS. 1 and 4. As with blind 8, blind 8' may be conveniently and quickly assembled and disassembled into a small, compact package which can be easily carried by a hunter or other user.

As will be apparent to those skilled in the art to which the invention is addressed, the present invention may be embodied in forms other than those specifically disclosed above without departing from the spirit or scope or essential characteristics of the invention. The particular embodiments of the blinds 8 and 8', described above, are therefore to be considered in all respects as illustrative and not restrictive. The scope of the present invention is as set forth in the appended claims rather than being limited to the examples of the blinds 8 and 8' set forth in the foregoing description.

The embodiments of the invention in which an exclusive property or privilege is claimed are defined as follows:

1. A portable, automatically and bidirectionally opening top for mounting a fabric or other type of covering material to overlie the opening of a pit, blind or similar structure, comprising:

(a) a frame extending along at least a portion of the perimeter of the top, said frame including a plurality of disassembleable, tubular, elongated members;

(b) a plurality of generally U-shaped, tubular rafter assemblies;

(c) means for pivotally connecting said rafter assemblies to said frame about a common axis of rotation; and, (d) means for in concert automatically pivoting said rafter assemblies about their common axis of rotation in the same selected rotational direction from a closed position of the top wherein said rafter assemblies are spaced apart relative to each other across the opening covered by the top, to an open position of the top whereby said rafter assemblies are positioned along one side of said frame, said automatic pivoting means comprising:

elongate, extendible, resilient means transversely spanning said rafter assemblies, said resilient means interconnected with the two furthermost spaced rafter assemblies and being in extended, biased condition when said top is in closed position; and, quick release means rotatably connecting said two furthermost spaced rafter assemblies to adjacent portions of said frame to nominally maintain said rafter assemblies in spaced-apart relationship across the opening being covered by the top when said top is in closed position, whereby upon release of said quick release means, said biased resilient means contracting to automatically pivot said rafter assemblies about their common pivot axis under the influence of said contracting resilient means in the direction away from said released quick release means to automatically shift said top into open position.

2. The top of claim 1, further comprising a fabric covering overlying and connected to said rafter assemblies.

3. The top of claim 2, wherein said covering is at least partially composed of mesh material.

4. A portable, automatically and bidirectionally opening top for mounting a fabric or other type of cover to overlie the opening of a pit, blind or similar structure, comprising:

(a) a frame extending along at least a portion of the perimeter of the top, said frame including a plurality of disassembleable, tubular, elongate members;

(b) a plurality of generally U-shaped, tubular rafter assemblies;

(c) means for pivotally connecting said rafter assemblies to said frame about a common axis of rotation; and, (d) means for in concert automatically pivoting said rafter assemblies about their common axis of rotation in the same selected rotational direction from a closed position of the top wherein said rafter assemblies are spaced apart relative to each other across the opening being covered by the top, to an open position of the top wherein said rafter assemblies are nested together along one side of the opening being covered by the top, said automatic pivoting means comprising biasing strap means transversly spanning said rafter assemblies, said biasing strap means interconnected with the two furthest spaced rafter assemblies and being in tension when said top is in closed position whereby said rafter assemblies are spaced apart from each other across the opening being covered by the top;

(e) quick release means connecting said furthest spaced rafter assemblies to said frame holding said biasing strap means tensioned.

5. The automaticaly opening top of claim 1, wherein said frame further comprising means for lockingly interconnecting said elongate frame members, said interconnecting means include a plurality of corner connectors having at least two socket portions angularly oriented to each other and sized to snugly and detachably receive end portions of said elongate frame members.

6. The automatically opening top of claim 5, wherein each said corner connector includes a web portion formed integral with and spanning between at least two of said sockets to define a ground-engaging surface.

7. The automatically opening top of claim 1, wherein said rafter assembies comprise: an elongate, tubular intermediate section; tubular arms angularly disposed to said elongate intermediate section to cooperatively define with said intermediate section a generally U-shape; means for disengageably connecting said arms to said elongate intermediate section; and, wherein the ends of said arms opposite said intermediate section are pivotally mounted on said frame by said connecting means.

8. The automatically opening top of claim 7, wherein said means for disengageably connecting said arms to said elongate intermediate section include elbow portions integrally formed with and extending angularly from the ends of said elongate intermediate section, each of said elbow portions having a socket formed therein capable of receiving a corresponding arm in slidable engagement therewith.

9. The automatically opening top of claim 1, wherein said means for pivotally connecting said rafter assemblies to said frame includes:

a U-bracket mounted on a frame member, said U-bracket having two spaced apart, inwardly disposed flanges, each having an aperture formed therein; and, a pivot pin extending through said flange apertures and through openings formed in said rafter assemblies.

10. The automatically opening top of claim 9, further including a plug having an insert end portion capable of snug engagement within the end portions of said rafter assemblies, and a head portion extending outwardly of the ends of said rafter assembly and having a cross hole formed therethrough to receive said pin.

11. The automatically opening top of claim 1, wherein said automatic pivoting means said quick release means comprising a strap and latch assembly releasably connecting said two furthermost spaced rafter assemblies to said frame to nominally maintain said rafter assemblies in spaced-apart relationship across the opening being covered by the top when the top is in closed position, whereby upon release of one of said quick release means said biasing strap means contracting to automatically pivot said rafter assemblies about their common pivot axes under the influence of said contracting biasing strap means in the direction away from said released quick release means to shift said top into open position.

12. A portable blind, comprising:

a frame structure of tubular construction having an opening therein; and, an automatic, bidirectionally-opening, collapsible top to mount a fabric or other type of material for covering the opening of said frame structure, comprising:

(a) a plurality of generally U-shaped rafter assemblies, said rafter assemblies being of tubular construction;

(b) means for pivotally connecting said rafter assemblies to said frame structure about a common axis of rotation; and, (c) means for in concert automatically pivoting said rafter assemblies about their common axes of rotation in the same selected rotational direction from a closed position of said top wherein said rafter assemblies are spaced apart relative to each other across the opening of said frame structure, to an open position of said top wherein said rafter assemblies are nested together at one side of the opening of said frame structure said automatic pivoting means comprising biasing strap means spanning said rafter assemblies, said biasing strap means interconnected with the two furthest spaced rafter assemblies and being in tension when said top is in closed position whereby said rafter assemblies are spaced apart from each other across the opening being covered by the top;

(d) quick release means connecting said furthest spaced rafter assemblies to said frame holding said biasing strap means tensioned.

13. The portable blind of claim 12, wherein said frame structure comprises a plurality of elongate tubular members and means for lockingly interconnecting said elongate tubular members, said interconnecting means include a plurality of corner connectors having at least two socket portions angularly oriented to each other for receiving the end portions of said elongate tubular members, at least some of said corner connectors having a web portion formed integral with and spanning between at least two of said socket portions to define a ground engaging bearing surface to support the blind.

14. The portable blind of claim 13, wherein said elongate members include tubular upright corner posts and upper and lower tubular crossmembers, each of said corner posts and crossmembers having a retractable button attached to each end portion thereof to nominally extend laterally beyond the outer surfaces of said corner posts and crossmembers to engage within corresponding openings formed in the socket portions of said corner connectors.

15. The portable blind of claim 12, wherein said generally U-shaped rafter assemblies are further comprised of an elongate tubular intermediate section and tubular arms angularly disposed to and disengageably connected to the ends of said elongate longitudinal section, with the ends of said arm opposite said intermediate section pivotally connected to said frame structure about a common axis of rotation.

16. The portable blind of claim 15, further comprising a fabric covering overlying and connected to said rafter assemblies.

17. The portable blind of claim 16, wherein said covering is at least partially composed of mesh material.

18. The portable blind of claim 15, wherein said intermediate sections of said rafter assemblies include integral, angular elbow portions each having a socket formed in the end portions thereof capable of receiving a corresponding arm in slidable engagement therein.

19. The portable blind of claim 12, wherein said means for pivotally connecting said rafter assemblies to said frame includes:

a U-bracket mounted on said frame structure, said U-bracket having two spaced apart, upwardly disposed flanges, each flange having an aperture formed therein; and, a pivot pin disposed through said apertures and through openings formed in said U-shaped rafter assemblies.

20. The portable blind of claim 19, further including plug means having an insert end portion snugly engageable within the ends of said rafter assemblies and opposite end portions extending beyond the ends of said rafter assemblies and having a cross hole formed therein to receive said pin.

21. The portable blind of claim 12, wherein said automatic pivoting means said quick release means comprising a strap and latch assembly releasably connecting said two furthermost spaced rafter assemblies to said frame structure to nominaly maintain said rafter assemblies in spaced-apart relationship when said top is in closed position, whereby upon release of one of said quick release means said biasing strap means contracting to automatically pivot said rafter assemblies about their common first axis under the influence of said contracting biasing strap means in the direction away from said released quick release means to shift said top into open position.

* * * * *